US011077383B2

(12) United States Patent
Chang

(10) Patent No.: US 11,077,383 B2
(45) Date of Patent: Aug. 3, 2021

(54) NOZZLE FOR INFLATING A BALLOON

(71) Applicant: NOVACORP INC., Guangzhou (CN)

(72) Inventor: Ming-Cheng Chang, Tainan (TW)

(73) Assignee: NOVACORP INC., Guangzhou (CN)

( * ) Notice: Subject to any disclaimer, the term of this patent is extended or adjusted under 35 U.S.C. 154(b) by 0 days.

(21) Appl. No.: 16/812,684

(22) Filed: Mar. 9, 2020

(65) Prior Publication Data

US 2020/0324217 A1 Oct. 15, 2020

(30) Foreign Application Priority Data

Apr. 15, 2019 (TW) ..... 108113088
Apr. 15, 2019 (TW) ..... 108204586

(51) Int. Cl.
*A63H 27/10* (2006.01)

(52) U.S. Cl.
CPC ..... *A63H 27/10* (2013.01); *A63H 2027/1033* (2013.01)

(58) Field of Classification Search
CPC ..... A63H 27/10; A63H 2027/1033; A63H 2027/1041; A63H 2027/1083; A63H 2027/1091
USPC ..... 446/222, 224, 220
See application file for complete search history.

(56) References Cited

U.S. PATENT DOCUMENTS 2,924,041 A * 2/1960 Jackson ..... A63H 27/10 446/224
3,616,569 A * 11/1971 Litt ..... A63H 27/10 446/220
4,034,501 A * 7/1977 Zeyra ..... A63H 27/10 446/224
4,094,347 A * 6/1978 Ikemoto ..... A63H 27/10 141/313
4,167,204 A * 9/1979 Zeyra ..... A63B 41/12 137/231
4,687,458 A * 8/1987 Handa ..... A63H 27/10 446/220
4,701,148 A * 10/1987 Cotey ..... A63H 27/10 137/223
4,911,674 A * 3/1990 Cole ..... A63H 27/10 137/853
5,067,301 A * 11/1991 Shore ..... A63H 27/10 53/79

(Continued)

FOREIGN PATENT DOCUMENTS

EP 001927386 6/2008 ..... A63H 27/10
GB 002363634 1/2002 ..... A63H 27/10

*Primary Examiner* — Joseph B Baldori
(74) *Attorney, Agent, or Firm* — Karin L. Williams; Alan D. Kamrath; Mayer & Williams PC

(57) ABSTRACT

A nozzle includes an expansion portion and a coupling portion having an inner end, an outer end, and an air hole extending from the inner end through the outer end. A connecting portion is connected between the expansion portion and the inner end and includes an opening intercommunicating with the air hole. The nozzle is coupled with a neck of a balloon. The expansion portion spreads the neck. The opening is received in the neck. The air hole intercommunicates with an inflation space defined in the balloon when a gas with a sufficient pressure is filled into the air hole. The air hole does not intercommunicate with the inflation space when no gas with the sufficient pressure is filled into the air hole.

6 Claims, 7 Drawing Sheets

(56) References Cited

U.S. PATENT DOCUMENTS

| | | | | |
|---|---|---|---|---|
| 5,370,161 | A * | 12/1994 | Shafer | A63H 27/10 141/114 |
| 6,488,557 | B1 * | 12/2002 | Elliott | A63H 27/10 446/220 |
| 6,622,759 | B2 * | 9/2003 | Yang | A63H 27/10 141/114 |
| 9,555,336 | B2 * | 1/2017 | Walz | A63H 27/10 |
| 10,814,239 | B1 * | 10/2020 | Allard | A63H 27/10 |

* cited by examiner

NOZZLE FOR INFLATING A BALLOON

BACKGROUND OF THE INVENTION

The present invention relates to a nozzle for inflating a balloon and, more particularly, to a nozzle that can easily fill a gas into a balloon and that can prevent the gas in the balloon from leaking when air inflation is stopped.

When inflating a balloon, a gas, such as air, is filled into a body of the balloon via an open end of a neck of the balloon. After the body of the balloon swells, the neck of the balloon must be tied to maintain the balloon in the swollen state. However, the operation is time-consuming, and the conventional inflating method cannot be effectively carried out through mechanical automation. Improvement is, thus, required.

BRIEF SUMMARY OF THE INVENTION

The present invention provides a nozzle comprising a coupling portion having an inner end and an outer end opposite to the inner end. The coupling portion further includes an air hole extending from the inner end through the outer end. The nozzle further comprises an expansion portion spaced from the coupling portion and a connecting portion connected between the expansion portion and the inner end of the coupling portion. The connecting portion includes an opening intercommunicating with the air hole. The nozzle is configured to couple with a neck of the balloon. The expansion portion is configured to be received in the neck of the balloon and is configured to spread the neck. The opening is received in the neck. The air hole intercommunicates with an inflation space defined in the balloon when a gas with a sufficient pressure is filled into the air hole, permitting the gas to enter the inflation space. The air hole does not intercommunicate with the inflation space defined in the balloon when no gas with the sufficient pressure is filled into the air hole.

The nozzle according to the present invention provides convenient inflation of the balloon. After inflation, the neck does not have to be tied or knotted without the risk of leaking of the gas filled into the receiving space of the balloon. The inflating speed can be increased, and continuous, rapid inflation can be carried out through mechanical automation for inflating a plurality of balloons.

In an example, the coupling portion further includes an outer periphery having an insertion groove between the inner end and the outer end. The insertion groove is configured to couple with an open end at a distal end of the neck of the balloon.

In an example, the coupling portion further includes a coupling groove between the insertion groove and the outer end. The coupling groove is configured to couple with one of a plurality of holders of a clamping board.

In an example, the expansion portion includes a first face and a second face opposite to the first face. Both the first face and the second face are conic. The expansion portion further includes a peripheral edge located between the first face and the second face. The peripheral edge is configured to spread the neck of the balloon. The neck of the balloon is separate from the first face and the peripheral edge to intercommunicate the air hole with the inflation space when the gas with the sufficient pressure is filled into the air hole. The first face and the peripheral edge abut against the neck of the balloon when no gas with the sufficient pressure is filled into the air hole.

The first face of the expansion portion is conic, such that a greater portion of the neck of the balloon airtightly abuts against the first face (in comparison with a planar face) when the balloon is not inflated, providing the best airtight effect. Thus, the inflated balloon can maintain the swollen state for a longer period of time.

In an example, the opening is radially inwards of the peripheral edge and is located between the first face and the inner end.

In an example, the coupling groove further includes a flange between the insertion groove and the inner end. The flange is configured to spread the neck of the balloon.

After the neck of the balloon is spread by the flange, even if the neck swells during the inflation of the balloon, the portion of the neck spread by the flange will not be affected, further avoiding the balloon separating from the nozzle.

The present invention will become clearer in light of the following detailed description of illustrative embodiments of this invention described in connection with the drawings.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
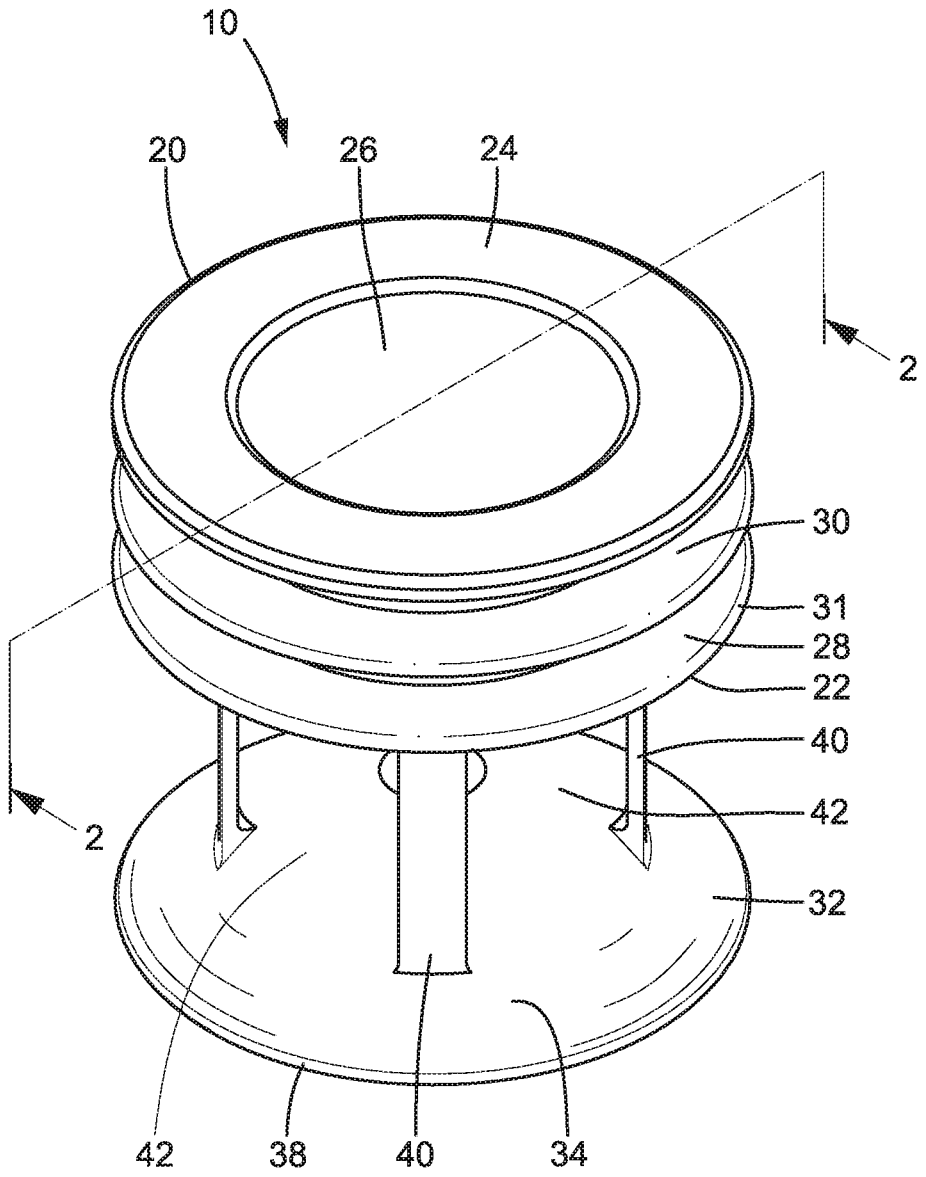
FIG. 1 is a perspective view of a nozzle for inflating a balloon of an embodiment according to the present invention.
Figure 2:
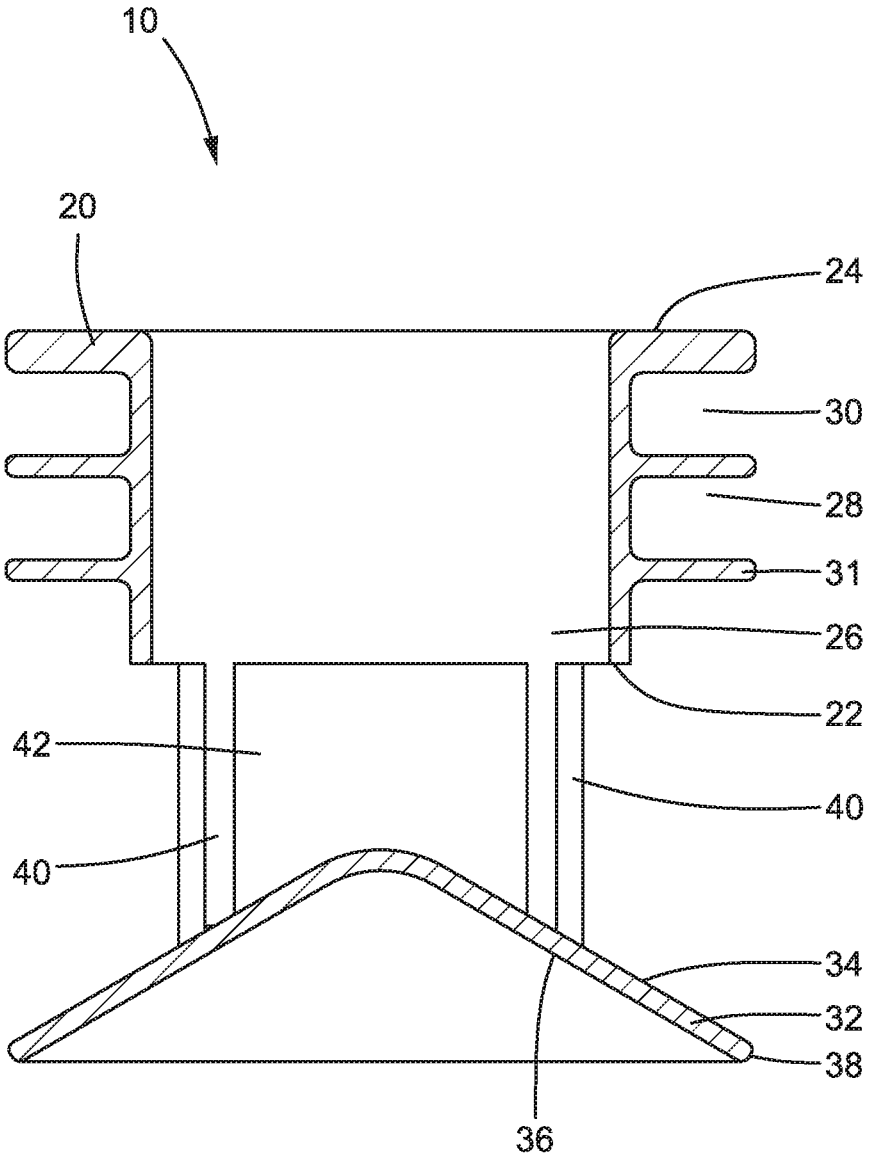
FIG. 2 is a cross sectional view taken along section line 2-2 of FIG. 1.

With reference to FIGS. 1-2, a nozzle 10 according to the present invention can be used to inflate a balloon and can prevent leakage after inflation. The nozzle 10 comprises a coupling portion 20 having an inner end 22 and an outer end 24 opposite to the inner end 22 in a longitudinal direction. The coupling portion 20 further includes an air hole 26 extending from the inner end 22 through the outer end 24. The coupling portion 20 further includes an outer periphery having an insertion groove 28 between the inner end 22 and the outer end 24 and a coupling groove 30 between the insertion groove 28 and the outer end 24. The insertion groove 28 and the coupling groove 30 are annular. The coupling groove 20 further includes a flange 31 between the insertion groove 28 and the inner end 22.

The nozzle 10 further comprises an expansion portion 32 spaced from the coupling portion 20 in the longitudinal direction and a connecting portion 40 connected between the expansion portion 32 and the coupling portion 20. The expansion portion 32 includes a first face 34 and a second face 36 opposite to the first face 34. Both the first face 34 and the second face 36 are conic. The expansion portion 32 further includes a peripheral edge 38 between the first face 34 and the second face 36. In this embodiment, the connecting portion 40 includes a plurality of connecting beams extending between the first face 34 of the expansion portion 32 and the inner end 22 of the coupling portion 20. The plurality of connecting beams is spaced from each other and is radially inwards of the peripheral edge 38. A plurality of openings 42 is defined between the coupling portion 20 and the expansion portion 32 and intercommunicates with the air hole 26. As shown in FIG. 2, the plurality of openings 42 is radially inwards of the peripheral edge 38 and is located between the first face 34 and the inner end 22.

Figure 3:
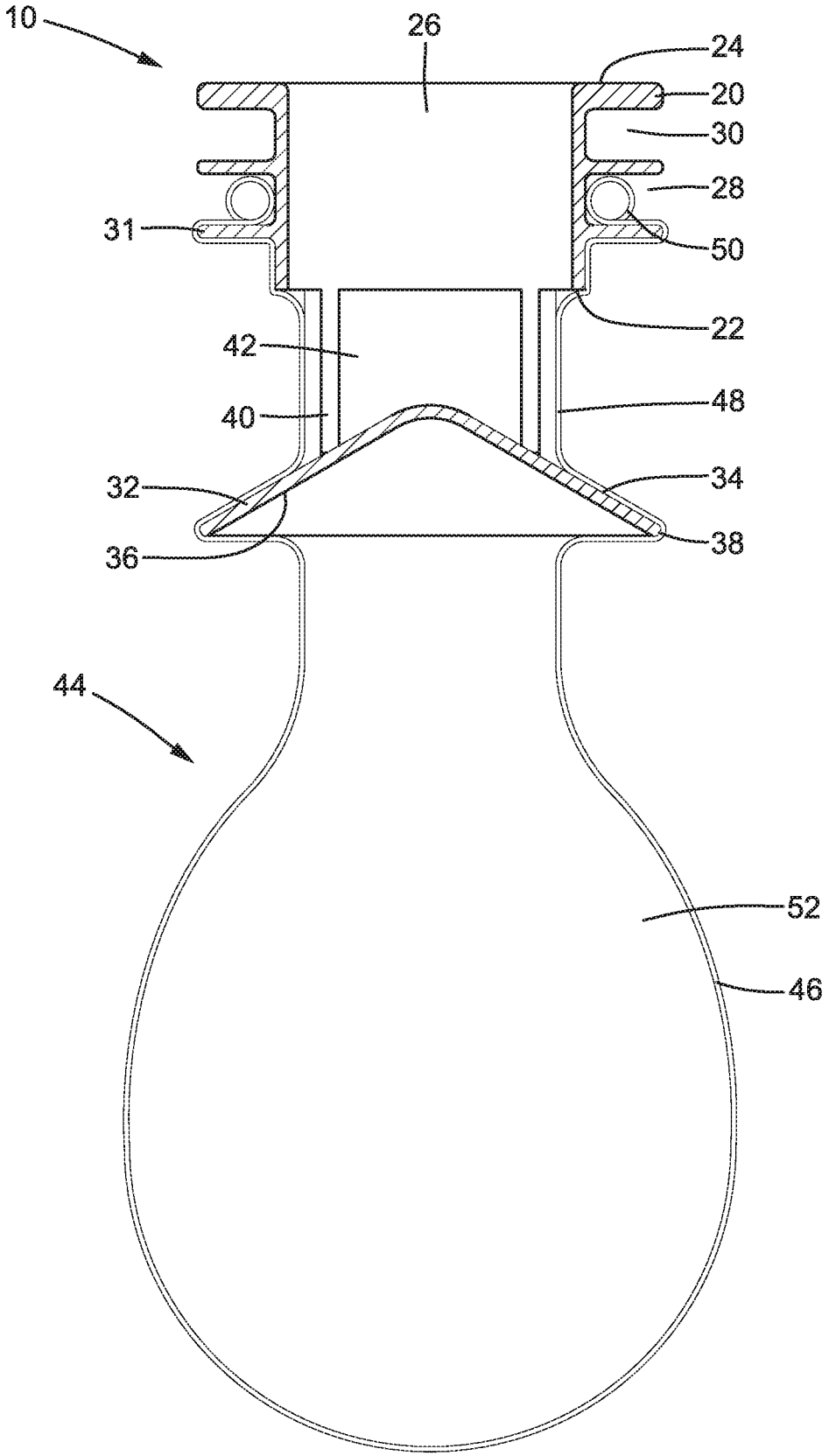
FIG. 3 is a cross sectional view illustrating the nozzle and a balloon to be inflated.

With reference to FIG. 3, the nozzle 10 is disposed to a neck 48 of a balloon 44 to be inflated. The balloon 44 includes a body 46 that extends from the neck 48 and that is larger than the neck 48. The neck 48 includes an open end 50 at a distal end thereof. An inflation space 52 is defined by the balloon 44. It is noted that the periphery of the expansion portion 32 is greater than the inner periphery of the neck 48 of the balloon 44, and an outer diameter of a bottom wall of the insertion groove 28 is greater than a diameter of the neck 48 of the balloon 44.

The nozzle 10 is inserted into the balloon 44 via the open end 50. The expansion portion 32 and the flange 31 of the nozzle 10 are located in the neck 48. The outer end 24 and the coupling groove 30 of the coupling portion 20 are located outside of the neck 48 of the balloon 44. The open end 50 of the balloon 44 engages with the insertion groove 28. The expansion portion 32 and the flange 31 spread the neck 48 of the balloon 44 outwards, as shown in FIG. 3. A portion of the neck 48 spread by the expansion portion 32 airtightly abuts against the first face 34 and the peripheral edge 38 of the expansion portion 32, such that the inflation space 52 of the balloon 44 does not intercommunicate with the openings 42 and the air hole 62. Thus, the air in the inflation space 52 cannot be discharged.

Figure 4:
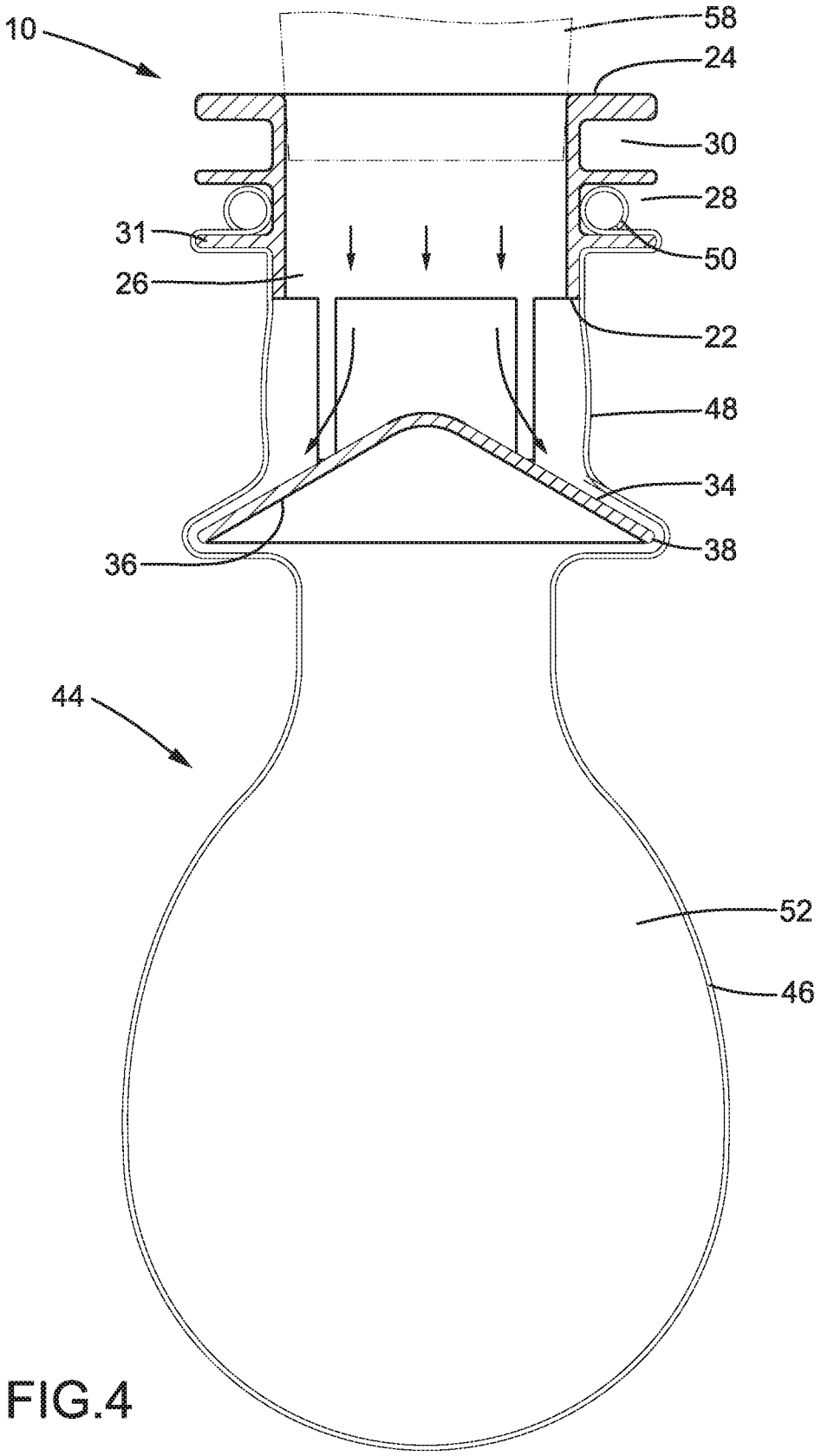
FIG. 4 is a cross sectional view illustrating inflation of the balloon through use of the nozzle.
Figure 5:
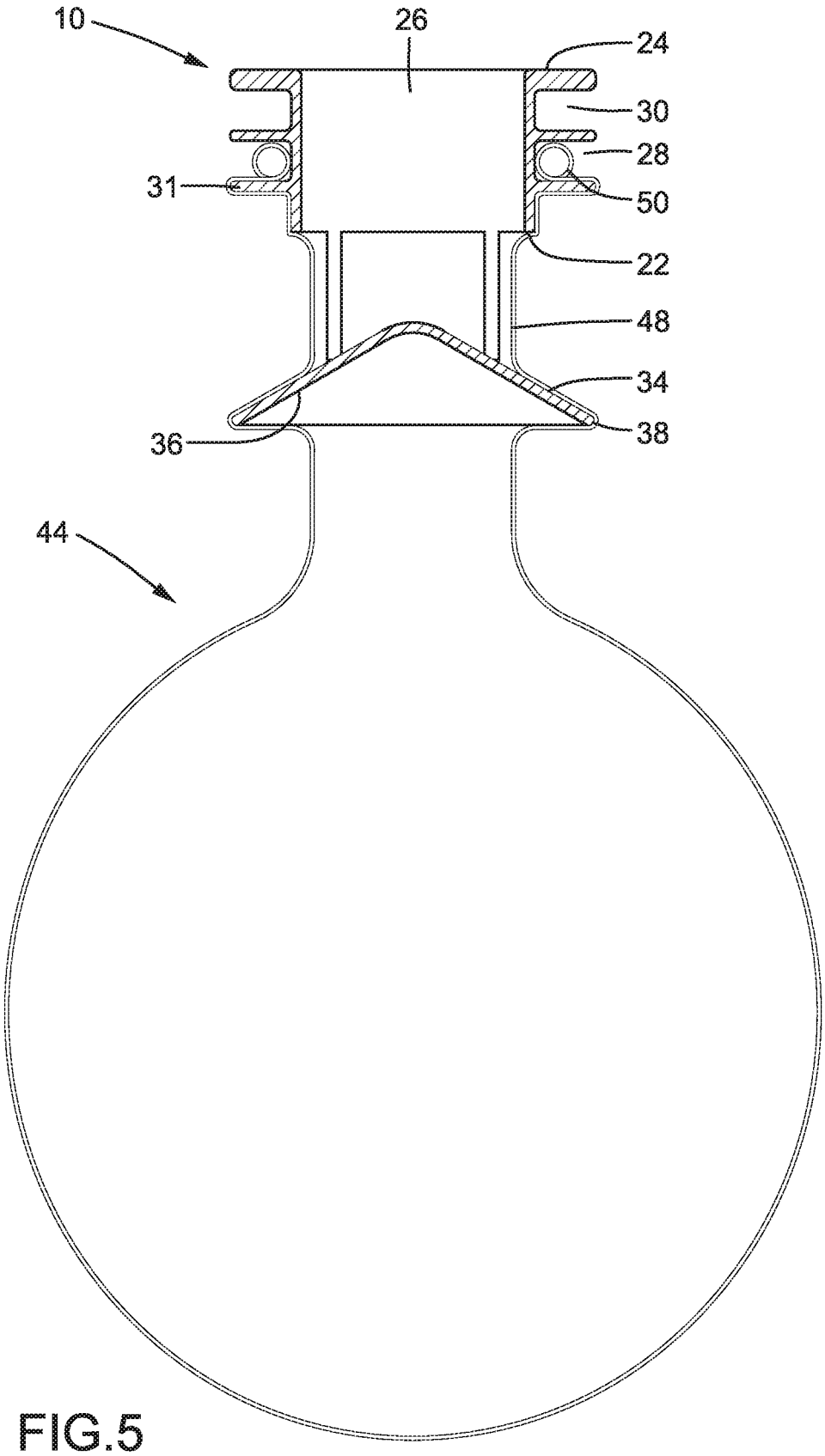
FIG. 5 is a cross sectional view of the nozzle and the balloon of FIG. 3 with the balloon inflated.

When inflating the balloon 44, inflating equipment 58 (see FIG. 4) is coupled with the air hole 26 of the nozzle 10. A gas, such as air, outputted from the inflating equipment 58 creates a pressure sufficient to overcome the elasticity of the neck 48 of the balloon 4 and the atmospheric pressure. Thus, the gas from the equipment 58 pushes the neck 48 outwards from each of the plurality of openings 42, forming a gap (see FIG. 4) separating an inner periphery of the neck 48 from the first face 34 and the peripheral edge 38. The gas from the equipment 58 passes through the gap and enters the inflation space 52 of the balloon 44, inflating the body 46 of the balloon 44. Furthermore, when the equipment 58 stops, the neck 48 of the balloon 44 abuts against the peripheral edge 38 and the first face 34 of the expansion portion 32 again under the action of the elasticity of the neck 48 and the atmospheric pressure. Thus, the gas filled into the receiving space 52 of the balloon 44 cannot leak, and the balloon 44 maintains the swelling state, as shown in FIG. 5.

It is noted that during inflation of the balloon 44, even if a portion of the neck 48 adjacent to the connecting portion 40 is slightly spread by the pressure of the gas, the portion of the neck 48 corresponding to the neck 31 is spread to a farther extent (see FIG. 4), such that the nozzle 10 is less likely to separate from the neck 48 of the balloon 44 during inflation procedure. This assures the inflating procedure is safer and smoother.

Figure 6:
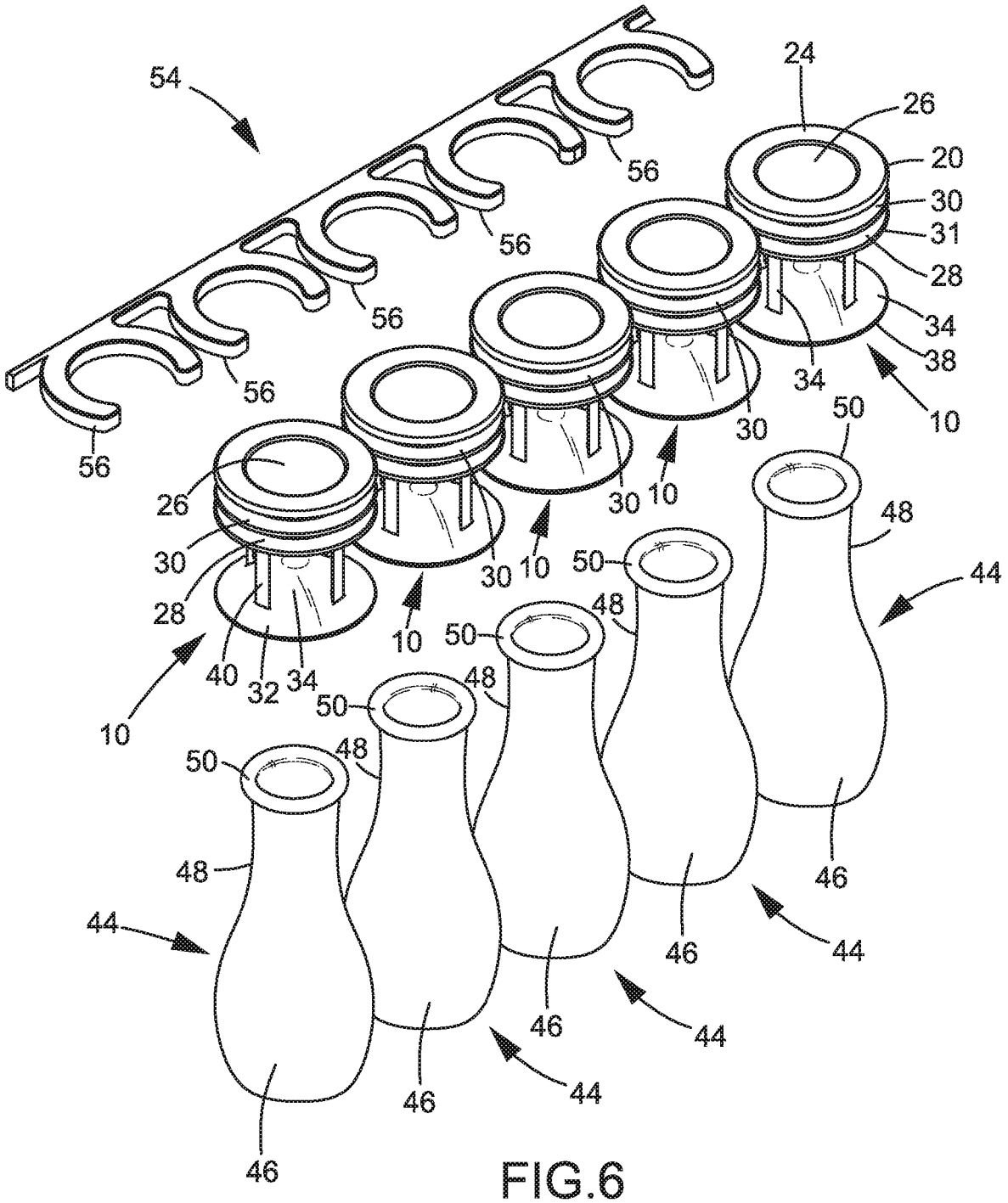
FIG. 6 is an exploded, perspective view illustrating a clamping board, a plurality of nozzles, and a plurality of balloons to be inflated.
Figure 7:
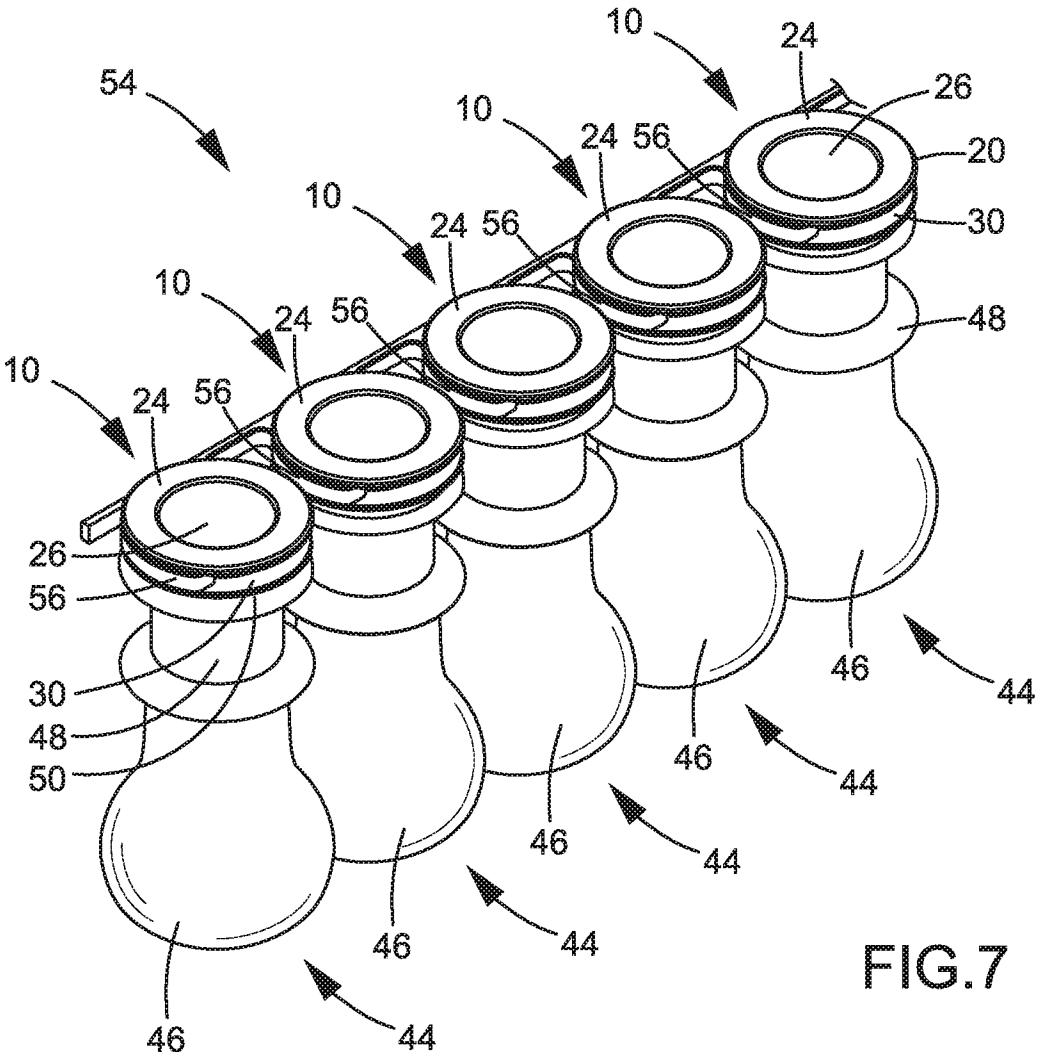
FIG. 7 is a perspective view of the clamping board, the plurality of nozzles, and the plurality of balloons of FIG. 6 after assembly.

With reference to FIGS. 6 and 7, the coupling groove 30 of the nozzle 10 can be coupled with a clamping board 54. The clamping board 54 includes a plurality of holders 46 spaced from each other by a proper spacing. The clamping board 54 can be used to hold a plurality of nozzles 10 and a plurality of balloons 44 to be inflated by the plurality of nozzles 10. Thus, the plurality of balloons 44 can be rapidly inflated by inflating equipment in a continuous manner and/or a circulating manner.

The nozzle 10 according to the present invention provides convenient inflation of the balloon 44. After inflation, the neck 48 does not have to be tied or knotted without the risk of leaking of the gas filled into the receiving space 52 of the balloon 44. The inflating speed can be increased, and continuous, rapid inflation can be carried out through mechanical automation for inflating a plurality of balloons 44.

Furthermore, the first face 34 of the expansion portion 32 is conic, such that a greater portion of the neck 48 of the balloon 44 airtightly abuts against the first face 34 (in comparison with a planar face) when the balloon 44 is not inflated, providing the best airtight effect. Thus, the inflated balloon 44 can maintain the swollen state for a longer period of time.

After the neck 48 of the balloon 44 is spread by the flange 31, even if the neck 48 swells during the inflation of the balloon 44, the portion of the neck 48 spread by the flange 31 will not be affected, further avoiding the balloon 44 from separating from the nozzle 10.

Now that the basic teachings of the present invention have been explained, many extensions and variations will be obvious to one having ordinary skill in the art. For example, the coupling portion 20 of the nozzle 10 does not have to include the insertion groove 28 and the coupling groove 30. In this case, the open end 50 of the balloon 44 is stretched to abut against an outer end face of the outer end 24 of the coupling portion 20 or to abut against a portion of the outer periphery of the coupling portion 20 including the inner end 22. Furthermore, the first face 34 and the second face 36 of the expansion portion 32 can be planar to provide a sufficient airtight effect, although the airtight effect is not as good as the conic arrangement. Furthermore, the nozzle 10 can include only one opening 42, and the connecting portion 40 can be tubular and can have the opening 42 at an interconnection of the tubular connecting portion 40.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A nozzle for inflating a balloon, comprising a coupling portion having an inner end and an outer end opposite to the inner end in a longitudinal direction, wherein the coupling portion further including an air hole extending from the inner end through the outer end in the longitudinal direction, wherein the nozzle further comprises an expansion portion spaced from the coupling portion and a connecting portion connected between the expansion portion and the inner end of the coupling portion, wherein the expansion portion includes a first face spaced from the inner end in the longitudinal direction and a second face opposite to the first face, wherein the expansion portion further includes a peripheral edge located between the first face and the second face, wherein the peripheral edge is configured to spread a neck of the balloon, wherein the nozzle is configured to couple with the neck, wherein the expansion portion is configured to be received in the neck of the balloon and is configured to spread the neck, wherein the air hole intercommunicates with an inflation space defined in the balloon when a gas with a sufficient pressure is filled into the air hole, permitting the gas to enter the inflation space, and wherein the air hole does not intercommunicate with the inflation space defined in the balloon when no gas with the sufficient pressure is filled into the air hole, wherein the neck of the balloon is spaced from the first face and the peripheral edge to intercommunicate the air hole with the inflation space when the gas with the sufficient pressure is filled into the air hole, wherein the peripheral edge and a portion of the first face abut against the neck of the balloon when no gas with the sufficient pressure is filled into the air hole, wherein the peripheral edge is radially outwards of the air hole, wherein the connecting portion includes a plurality of connecting beams spaced from each other in an annular direction around a longitudinal axis of the air hole and located radially outwards of the air hole, wherein each of the plurality of connecting beams is connected between the first face of the expansion portion and the inner end of the coupling portion, wherein each two adjacent beams have an opening therebetween, wherein each opening is located radially outwards of the air hole, intercommunicates with the air hole, and extends between the first face of the expansion portion and the inner end of the coupling portion in the longitudinal direction, and wherein the gas with the sufficient pressure flows from the air hole through the openings, flows along the first face of the expansion portion, flows through a gap between the peripheral edge and the balloon into the inflation space of the balloon.

2. The nozzle for inflating the balloon as claimed in claim 1, wherein the coupling portion further includes an outer periphery having an insertion groove between the inner end and the outer end, and wherein the insertion groove is configured to couple with an open end at a distal end of the neck of the balloon.

3. The nozzle for inflating the balloon as claimed in claim 2, wherein the coupling portion further includes a coupling groove between the insertion groove and the outer end, and wherein the coupling groove is configured to couple with one of a plurality of holders of a clamping board.

4. The nozzle for inflating the balloon as claimed in claim 1, wherein the expansion portion is solid to prevent the gas from flowing from the inner face through the second face, and wherein both the first face and the second face are conic.

5. The nozzle for inflating the balloon as claimed in claim 4, wherein the openings are radially inwards of the peripheral edge.

6. The nozzle for inflating the balloon as claimed in claim 1, wherein the coupling groove further includes a flange between the insertion groove and the inner end, and wherein the flange is configured to spread the neck of the balloon.

* * * * *